US008665036B1

(12) United States Patent
Edwards et al.

(10) Patent No.: US 8,665,036 B1
(45) Date of Patent: Mar. 4, 2014

(54) COMPACT TRACKING COUPLER

(75) Inventors: Richard G. Edwards, Grantsville, UT (US); Rory K. Sorensen, Kaysville, UT (US); Jeffrey J. Hirasuna, Kaysville, UT (US)

(73) Assignee: L-3 Communications, New York, NY (US)

( * ) Notice: Subject to any disclaimer, the term of this patent is extended or adjusted under 35 U.S.C. 154(b) by 294 days.

(21) Appl. No.: 13/173,930

(22) Filed: Jun. 30, 2011

(51) Int. Cl.
*H01P 5/12* (2006.01)

(52) U.S. Cl.
USPC ..... 333/135; 333/137

(58) Field of Classification Search
USPC ..... 333/113, 122, 135, 137, 21 R, 230, 251, 333/252
See application file for complete search history.

(56) References Cited

U.S. PATENT DOCUMENTS

| | | | | |
|---|---|---|---|---|
| 2,748,350 | A | | 5/1956 | Miller |
| 2,954,558 | A | * | 9/1960 | Honey et al. ..... 343/773 |
| 3,566,309 | A | | 2/1971 | Ajioka |
| 3,582,950 | A | | 6/1971 | Tanaka |
| 3,906,508 | A | | 9/1975 | Foldes |
| 3,936,838 | A | | 2/1976 | Foldes |
| 4,030,048 | A | | 6/1977 | Foldes |
| 4,367,446 | A | | 1/1983 | Hall |
| 4,420,756 | A | | 12/1983 | Hamada et al. |
| 4,566,012 | A | | 1/1986 | Choung et al. |
| 4,704,611 | A | | 11/1987 | Edwards et al. |
| 4,742,317 | A | | 5/1988 | Thal, Jr. |
| 4,847,574 | A | * | 7/1989 | Gauthier et al. ..... 333/21 A |
| 4,897,609 | A | * | 1/1990 | Mallavarpu ..... 330/43 |
| 4,929,955 | A | | 5/1990 | Miles et al. |
| 5,043,629 | A | * | 8/1991 | Doane ..... 315/5 |
| 5,402,089 | A | | 3/1995 | Tsuda et al. |
| 5,410,318 | A | | 4/1995 | Wong et al. |
| 5,583,469 | A | | 12/1996 | Weinstein et al. |
| 5,617,108 | A | | 4/1997 | Silinsky et al. |
| 5,635,944 | A | | 6/1997 | Weinstein et al. |
| 5,736,907 | A | | 4/1998 | Chen et al. |
| 5,784,033 | A | * | 7/1998 | Boldissar, Jr. ..... 343/786 |
| 5,793,334 | A | | 8/1998 | Anderson et al. |
| 5,793,335 | A | | 8/1998 | Anderson et al. |
| 5,818,396 | A | | 10/1998 | Anderson et al. |
| 5,907,309 | A | | 5/1999 | Anderson et al. |
| 6,222,492 | B1 | | 4/2001 | Mahon |
| 2002/0163401 | A1 | * | 11/2002 | Zhang ..... 333/135 |
| 2006/0119504 | A1 | | 6/2006 | Maquet et al. |
| 2010/0052816 | A1 | | 3/2010 | Reiche et al. |

OTHER PUBLICATIONS

Choung et al., "Theory and Design of a *Ku*-Band $TE_{21}$-Mode Coupler", IEEE Transactions on Microwave Theory and Techniques, vol. 30, No. 11, Nov. 1982, pp. 1862-1866.

Cavalier, Mark, "Feed for Simultaneous X-Band and KA-Band Operations on Large Aperture Antennas", Article, 5 pages, IEEE, 2007, Richardson, Texas.

(Continued)

*Primary Examiner* — Robert Pascal
*Assistant Examiner* — Kimberly Glenn
(74) *Attorney, Agent, or Firm* — Kirton McConkie

(57) ABSTRACT

A compact tracking coupler includes a plurality of ridged waveguides arranged circumferentially around a circular waveguide wherein long sides of the ridged waveguides extend circumferentially and short sides of the ridged waveguides extend radially relative to the circular waveguide. The compact tracking coupler can be especially useful in a multi-band antenna feed.

20 Claims, 5 Drawing Sheets

(56) References Cited

OTHER PUBLICATIONS

Seck, Gerry, "S-Band Mode Coupler Feed", IEEE Article, 1987, 4 pages, Simi Valley, California.
Savini, D., "An Improved Automatic Tracking System for Linear and Circular Polarization", 1980, pp. 480-484.
Patel, Sharad, "A Tri-band Reflector Antenna with Dual Band $TE_{21}$ Mode Tracking", IEEE Article, 1999, pp. 700-703.
Du, Biao, "Wide-Band Linearly or Circularly Polarized Monopulse Tracking Corrugated Horn", IEEE Transactions on Antennas and Propagation, vol. 50, No. 2, Feb. 2002, pp. 192-197.
Choung, Y.H., "Wideband $TM_{01}$-Mode Travelling Wave Coupler", IEE Proc.-Microw. Antennas Propag., vol. 144, No. 5, Oct. 1997, pp. 315-320.
Sakr, Lotfy, "The Higher Order Modes in the Feeds of the Satellite Monopulse Tracking Antennas", IEEE Melecon 2002, Cairo Egypt, pp. 453-457.
Choung, et al., "Ku-Band Tracking Feed for Earth Terminal Operation", Article, Ford Aerospace & Communications Corporation, California, 1982, pp. 632-635.
Cha, et al., "An Analytic Study of the Performance of Electronics Tracking Feeds in a Beam Waveguide Antenna", Article, Jet Propulsion Laboratory, California Institute Technology, 1992, pp. 12-15.
Cooper, Lee J., "A Frequency Reuse, Monopulse Tracking Feed for Cassegrain Antenna Applications", Rantec Division, Emerson Electric Co., 1980, pp. 97-100.
Cipolla, et al,, "High Efficiency Autotrack Feed", Datron Systems Incorporated, Simi Valley, California, 1989, pp. 316-320.

* cited by examiner

COMPACT TRACKING COUPLER

FIELD

The present application relates to antenna feed systems. More particularly, the present application relates to a compact tracking coupler useful in antenna feeds.

BACKGROUND

Antennas are used for the radiation and capture of electromagnetic energy. For example, a wireless communications system typically includes one or more antennas on each node within the system. Improved link performance can sometimes be obtained by using antennas which focus or concentrate radiated energy in a particular direction. In particular, by focusing radiated energy (e.g., within a narrow beamwidth) toward a node being transmitted to, rather than sending energy in all directions (e.g., isotropically), the resulting increase in energy can translate into improved link performance (e.g., lower error rate, higher signal quality, increased range, etc.). Such antennas are referred to as directional antennas. Because antennas can operate in a reciprocal manner, similar performance gains can be obtained when using a directional antenna for transmitting or receiving.

There is a tradeoff, however, when using directional antennas. If the antenna is not pointed directly at the other end of the communications link, performance gains can be lost, and performance can even be worse than using an isotropic antenna. Accordingly, it is helpful to provide techniques to ensure that the antenna is correctly pointed. When one or both ends of the communications link are moving, maintaining correct antenna pointing can be difficult.

One approach to maintaining antenna pointing is to perform tracking, where measurements of the signal are used to determine whether the antenna is pointing correctly. Tracking systems to date have failed to provide the desired cost, performance, and other characteristics. In particular, tracking systems are often bulky, resulting in undesirable weight. Bulky tracking systems can also cause undesired blockage of the antenna aperture. Blockage can be particularly problematic in multi-band antenna feeds.

SUMMARY

In some embodiments, a compact tracking coupler for use in a multi-band antenna feed is provided. The compact tracking coupler can include a circular waveguide having an outer perimeter. A plurality of ridged waveguides can be disposed circumferentially around the circular waveguide. The ridged waveguides can each have a pair of short sides and pair of long sides. The long sides can be positioned adjacent to the outer perimeter of the circular waveguide and the short sides can extend radially outward from the circular waveguide. A plurality of openings can be disposed between each of the ridged waveguides and the circular waveguide.

In some embodiments, a multi-band antenna feed is provided. A first frequency band coaxial waveguide feed can include an outer conductor and an inner conductor. The inner conductor can be coaxially disposed within the outer conductor, and the inner conductor can be separated from the outer conductor by a dielectric space. The inner conductor can include a compact tracking coupler, where the compact tracking coupler includes a second frequency band circular waveguide and a plurality of second frequency band ridged waveguides. The ridged waveguides can be coupled to an outer perimeter of the circular waveguide through long sides of the ridged waveguides with short sides of the ridged waveguides extending radially outward from the circular waveguide.

In some embodiments, a method of making a compact tracking coupler for use in a multi-band antenna feed is provided. The method can include forming a circular waveguide having an outer perimeter, wherein the circular waveguide has a first phase velocity. The method can also include configuring a plurality of ridged waveguides to have a second phase velocity substantially equal to the first phase velocity. Another operation in the method can be coupling the plurality of ridged waveguides around the circular waveguide so that a short dimension of the ridged waveguides extends radially with respect to the circular waveguide and a long dimension of the ridged waveguides extends circumferentially with respect to the circular waveguide.

BRIEF DESCRIPTION OF THE DRAWINGS

Additional features and advantages of the invention will be apparent from the detailed description that follows, taken in conjunction with the accompanying drawings, that together illustrate, by way of example, features of the invention; and, wherein.

DETAILED DESCRIPTION

Figure 1A:
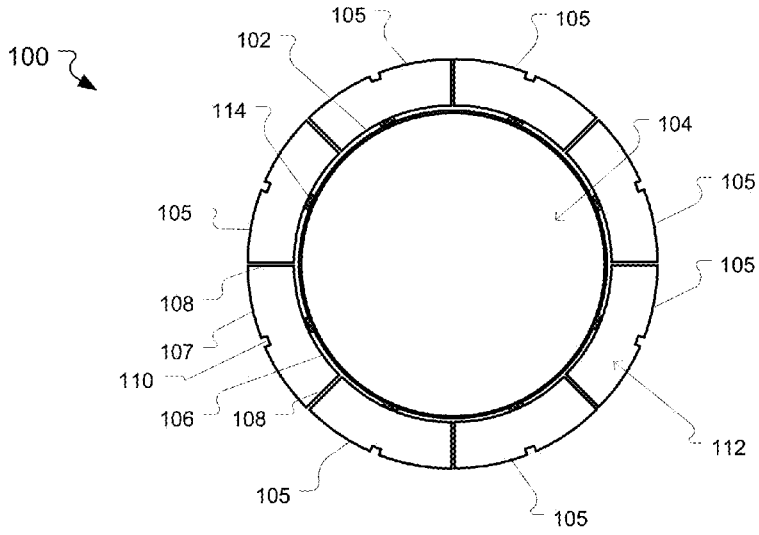
FIG. 1A is a front cross-section view illustration of a compact tracking coupler in accordance with some embodiments of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

In describing the present invention, the following terminology will be used:

The singular forms "a," "an," and "the" include plural referents unless the context clearly dictates otherwise. Thus, for example, reference to a terminal includes reference to one or more terminals.

The term "ones" refers to one, two, or more, and generally applies to the selection of some or all of a quantity. The term "plurality" refers to two or more of an item.

As used herein, the term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like, and other factors known to those of skill in the art.

As used herein, the term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3 and 4 and sub-ranges such as 1-3, 2-4 and 3-5, etc. This same principle applies to ranges reciting only one numerical value (e.g., "greater than about 1") and should apply regardless of the breadth of the range or the characteristics being described.

As used herein, a plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items.

As used herein, the term "alternatively" refers to selection of one of two or more alternatives, and is not intended to limit the selection to only those listed alternatives or to only one of the listed alternatives at a time, unless the context clearly indicates otherwise.

Figure 1B:
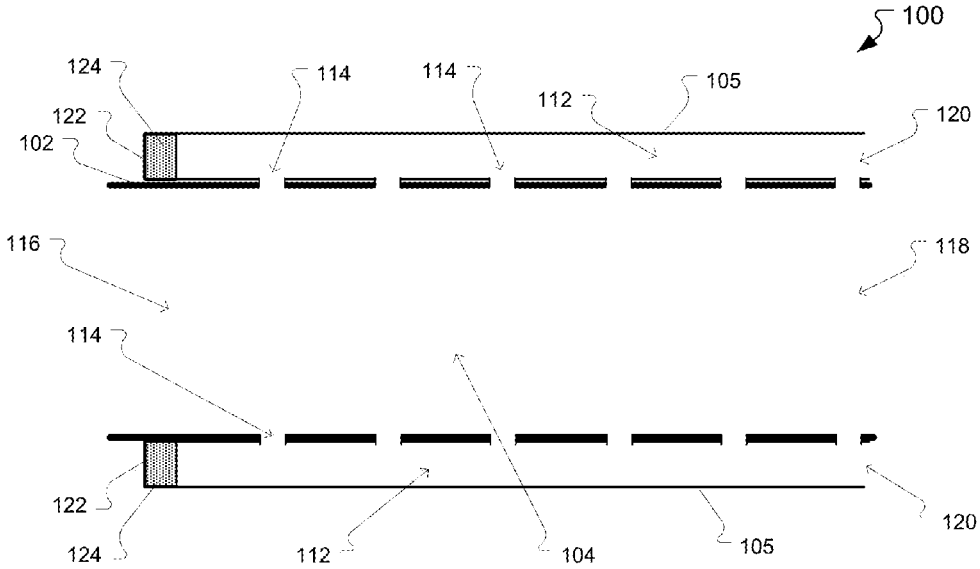
FIG. 1B is a side cross-section view illustration of the compact tracking coupler of FIG. 1A.

Turning to FIGS. 1A-1B, a compact tracking coupler is illustrated in accordance with some embodiments of the present invention. The coupler, shown generally at 100, can include a circular waveguide 102. For example, the circular waveguide can include a conductive shell. The interior 104 of the conductive shell can be open (e.g., filled with air or gas) or the interior can be filled with a dielectric material. Arranged around the outer perimeter of the circular waveguide can be a number of ridged waveguides 105. For example, in some embodiments, eight ridged waveguides can be provided, and the ridged waveguides can be equally spaced around the circular waveguide. The interior 112 of the ridged waveguides can be open (e.g., filled with air or gas) or the interior can be filled with a dielectric material. Dielectric material placed into the interior of the ridged waveguides can be the same or different from dielectric material placed into the interior of the circular waveguide. The ridged waveguide can have various cross sections which include two short sides and two long sides. For example, as illustrated here, the ridged waveguides can have a circularly truncated circular sector shape which has been modified by the inclusion of a ridge 110. The circularly truncated circular sector shape can include a pair of longer sides 106, 107 that are arcs (inner arc 106 and outer arc 107 extending circumferentially around the circular waveguide) and a pair of shorter sides 108 that are straight (extending radially outward from the circular waveguide). Alternatively, in some embodiments, the ridged waveguides can have a trapezoidal cross section (plus one or more ridges) as described further below. In yet other embodiments, the ridged waveguides can have a rectangular cross section (plus one or more ridges). In some embodiments, the ridged waveguides can have a quadrilateral cross section which comprises a pair of relatively shorter sides and a pair of relatively longer sides.

The ridged waveguide 105 can have a cross section that is modified by one or more indentations (ridges) 110 in the sides, thus forming a ridged waveguide. The ridge can have the effect of modifying phase velocity within the waveguide, thereby allowing a smaller waveguide to support waveguide modes for a desired frequency (e.g., lowering the cutoff frequency relative to a waveguide of the same cross section without the ridge(s)). In some embodiments, the ridge can be sufficiently large such that the waveguide has a dumbbell or barbell shape. Furthermore, although the ridge is shown here as having a rectangular cross section, it will be appreciated that other shaped ridges can be used as well, including for example, semicircular, half oval, and the like. Although the ridge 110 is shown on the outer side 107, the invention is not so limited, and in some embodiments the ridge can be on the inner side 106.

The ridged waveguides 105 can be positioned so that one of the longer sides 106 is adjacent to the outer perimeter of the circular waveguide 102. Openings 114 can be disposed between the ridged waveguides and the outer perimeter of the circular waveguide. The circular waveguide can include an open end 116, which is used to transmit/receive radiation. The other end 118 of the circular waveguide can be connected to additional waveguide or waveguide-coax transitions (not shown) for connection to a transmitter, receiver, or transceiver. The ridged waveguides can also include open ends 120, which can be connected to additional waveguide or waveguide-coax transitions (not shown) for connection to a radio frequency (RF) tracking receiver. The ridged waveguides can include closed ends 122, which can each include an RF absorber 124. For example, an RF absorber load, such as shown in U.S. Pat. No. 7,868,714 (the disclosure of which is herein incorporated by reference to the extent it does not conflict with the present application) can be used to absorb electromagnetic energy from misdirected portions of the TE21 modes coupled into the ridged waveguides. Use of the foregoing compact absorber load can also help to reduce the overall diameter of the compact tracking coupler 100.

Operation of the coupler 100 will now be explained. Incoming radio frequency energy is coupled into the open end 116 of the circular waveguide 102. Two orthogonal degenerate TE11 (transverse electric) dominant circular waveguide modes can be produced (e.g., corresponding to horizontal and vertical polarization). When the waveguide is perfectly aligned with the source of radio frequency energy, only the TE11 modes are produced. In contrast, when there is a misalignment, reduced energy is coupled into the TE11 modes, and some energy is coupled into TE21 higher-order circular waveguide modes. Two different orthogonal degenerate TE21 modes can be produced (corresponding to misalignment in two orthogonal directions, e.g., azimuth and elevation). Energy in the TE21 modes can couple through the openings 114 into the ridged waveguides 105 while coupling of the TE11 modes into the ridged waveguides is suppressed. Accordingly, the TE11 mode energy in the circular waveguide is substantially undisturbed, propagating towards the other end 118 of the circular waveguide, while the TE21 mode energy is extracted by the ridged waveguides.

The relative strengths of the TE21 mode energy coupled into the ridged waveguides 105 depends on the orientation of the compact tracking coupler 100 relative to the source of the RF energy, with the amount of energy generally increasing as more misalignment is present, and the amount of energy coupled into particular ones of the ridged waveguides being dependent on the direction of misalignment. Accordingly, the outputs 120 from the ridged waveguides can be used to produce pseudo monopulse tracking information. For example, in some embodiments, the energy in the TE21 modes of the circular waveguide can be coupled into the ridged waveguides (where it can be converted into TE10 dominant rectangular waveguide mode), and the output from the ridged waveguides can be combined (e.g., using stripline, microstrip, magic-T hybrids, etc.) to produce an azimuth error signal and an elevation error signal. The error signals can be used by a servo control loop to steer the antenna.

It will be noted that coupling occurs through one of the long sides 106 (e.g., the "a" dimension) of the ridged waveguides. This is in contrast to conventional tracking couplers that achieve coupling through one of the short sides (e.g., the "b" dimension) of a rectangular waveguide. Maximum coupling of the TE21 modes can be achieved by matching the phase velocity of the outer ridged waveguides 105 to the phase velocity of the central circular waveguide 102. The phase velocity of a rectangular waveguide is proportional to the length of the long side ("a" dimension). Thus, it is not possible to couple through the long side in a conventional tracking coupler because the optimal length of the "a" dimension multiplied by eight exceeds the circumference of the circular waveguide. In other words, in a conventional tracking coupler design, it is not mechanically possible to place eight rectangular waveguides around the outer perimeter of an inner circular waveguide. If the "a" dimensions are scaled down so the rectangular waveguides can fit, there is very poor coupling due to phase velocity mismatch between the rectangular waveguides and the circular waveguide. Moreover, if the "a" dimension is scaled down too much, the cutoff frequency of the rectangular waveguide is too high to allow the desired modes to propagate.

The compact tracking coupler 100 can avoid the aforementioned problems by making use of ridged waveguides 105. The ridged waveguides decrease the "a" dimension relative to a conventional rectangular waveguide while maintaining the same phase velocity. Accordingly, by using ridged waveguides, it is possible to fit the long dimension of the eight ridged waveguides around the perimeter of the circular waveguide 102 without sacrificing coupling efficiency. Since the ridged waveguides are turned so the long "a" dimension is adjacent to the circular waveguide, only the short "b" dimension extends radially outward. This can help to reduce the radial cross section (diameter) of the compact tracking coupler (and weight) compared to a conventional tracking coupler. Furthermore, this diameter reduction can allow the compact tracking coupler to serve a dual purpose as the center conductor for a lower-frequency coaxial waveguide in a multi-band feed configuration (e.g., an X/K-band feed). A traditional tracking coupler, which has a larger outer diameter, is not well suited for multi-band feeds for various reasons. First, a coaxial waveguide with a larger inner diameter, due to the larger outer diameter of the tracking coupler, would require a larger outer diameter as well to maintain the proper diameter ratio necessary to support signal propagation in the lower frequency band. This would lead to additional blockage when used in a center-fed reflector antenna. Second, a larger inner diameter would also produce a larger impedance mismatch between the coaxial waveguide and its turnstile feed (four rectangular waveguides orthogonally oriented and equally spaced around the outer cylindrical wall of a coaxial waveguide). Examples of dual-band feeds using embodiments of compact tracking couplers are described in further detail below.

As mentioned above, dielectric material can be included in the circular waveguide 102, the ridged waveguides 105, or both. Dielectric material can be helpful in further reducing the size of the compact tracking coupler 100, since dielectric loading helps to provide a smaller waveguide cross section for a given phase velocity. Moreover, use of dielectric material can be used to enhance matching the propagation constant of the circular waveguide and the ridged waveguides. For example, the circular waveguide can be loaded with a dielectric material having a lower dielectric constant than the ridged waveguides, helping to allow the long dimension of the ridged waveguides to match the exterior perimeter dimension of the circular waveguide.

Figure 2:
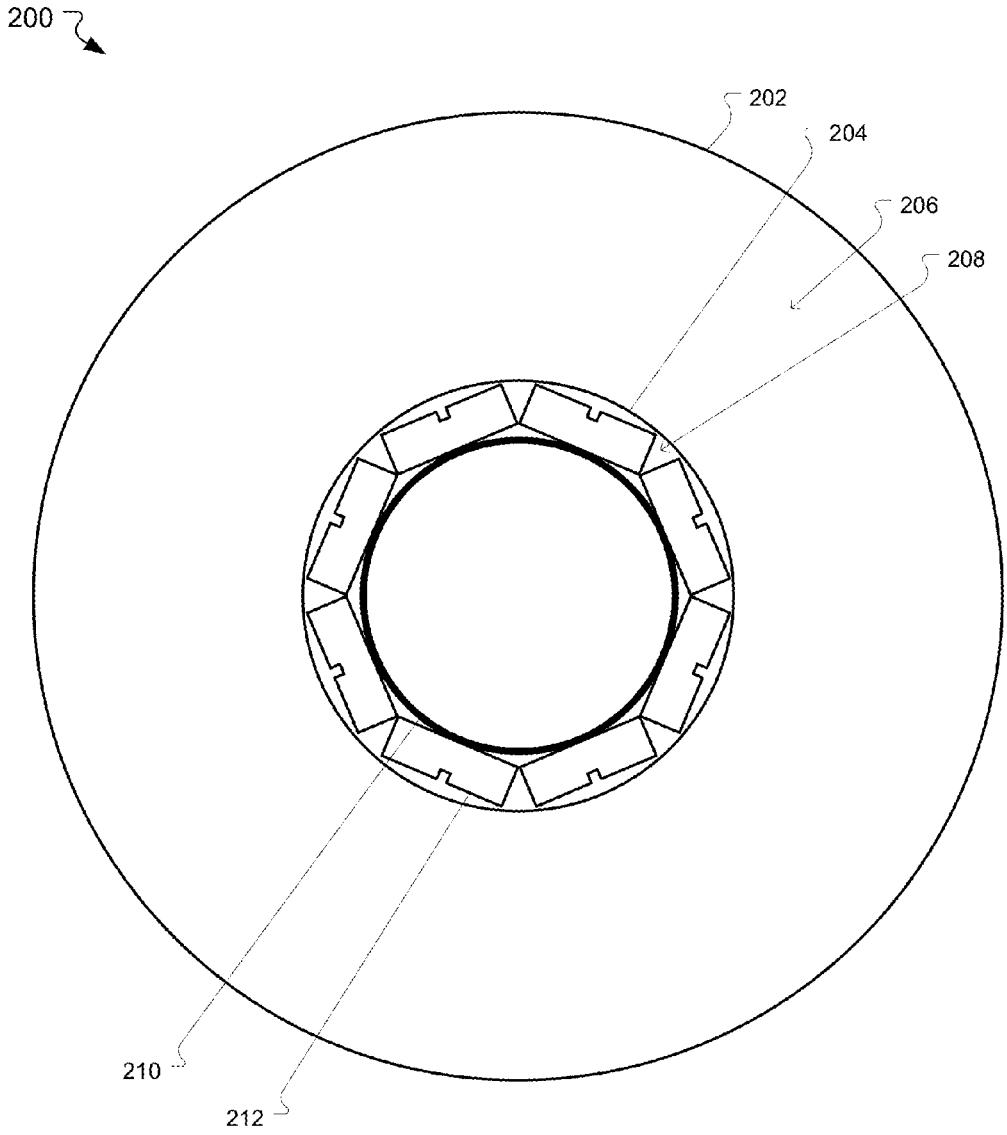
FIG. 2 is a front view illustration of a dual-band antenna feed in accordance with some embodiments of the present invention.
Figure 3A:
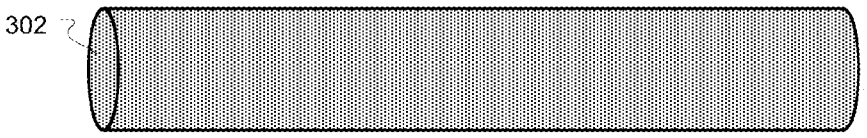
FIGS. 3A-3E illustrate various operations of a method of making a compact tracking coupler in accordance with some embodiments of the present invention.
Figure 3B:
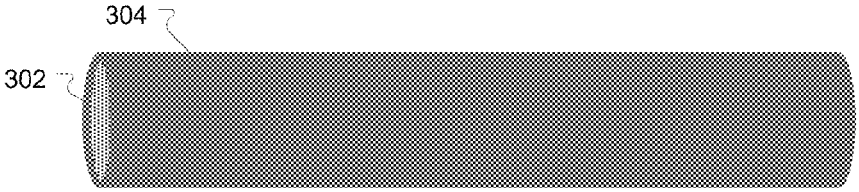
Figure 3C:
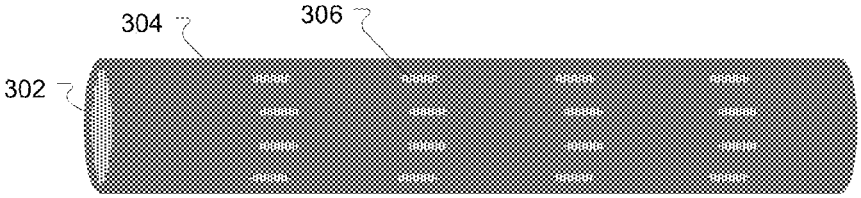
Figure 3D:
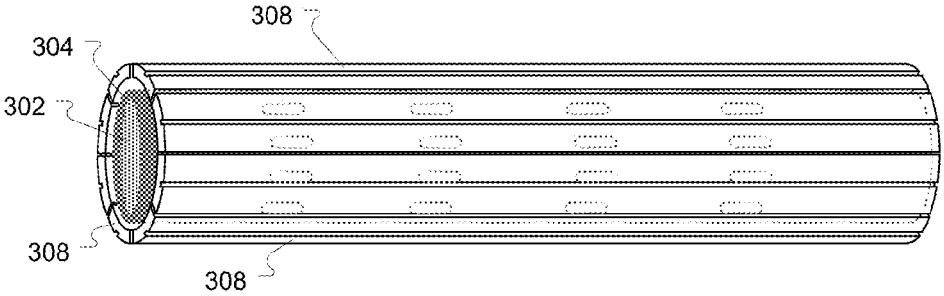
Figure 3E:
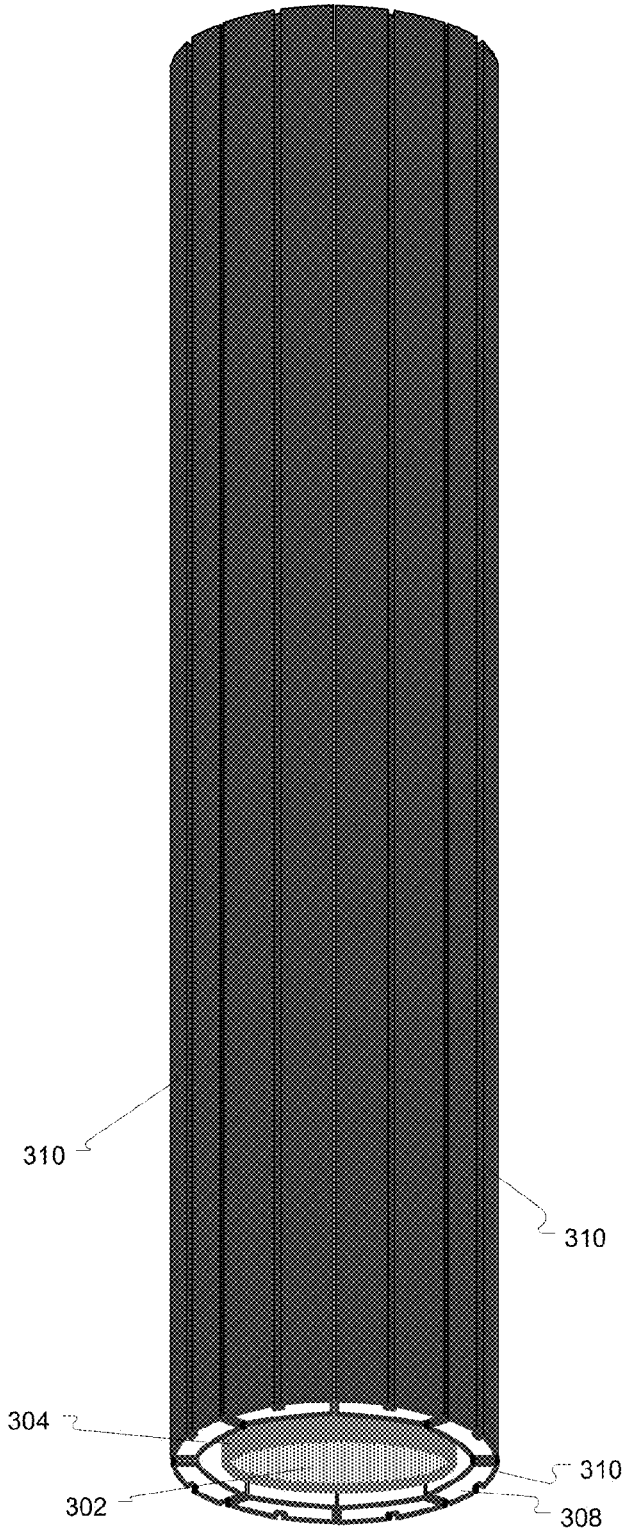

A compact tracking coupler can be advantageously used in a multi-band antenna feed. For example, FIG. 2 illustrates a front view of a dual-band antenna feed in accordance with some embodiments of the present invention. The dual-band antenna feed can provide for operation on a first frequency band and a second frequency band, wherein the second frequency band can be higher in frequency than the first frequency band.

The dual-band antenna feed, shown generally at 200, can include a coaxial waveguide feed for operation within the first frequency band (e.g., X band). The coaxial waveguide feed can include an inner conductor 204 and an outer conductor 202 separated by a dielectric space 206. For example, the dielectric space can be open air or a dielectric material. The coaxial waveguide feed can be dimensioned (e.g., inner and outer diameters) to support operation within the first frequency band. For example, the coaxial waveguide feed can be used as the feed for a parabolic reflector (not shown).

Disposed within (or functioning as) the inner conductor 204 can be a compact tracking coupler 208. The compact tracking coupler can include a circular waveguide 210 for operation within the second frequency band (e.g., K band). For example, the circular waveguide can have a dimension sufficient to support propagation of one or more modes within the second frequency band. Disposed around circular waveguide and coupled to the circular waveguide through long sides can be a plurality of ridged waveguides 212. Short sides of the ridged waveguides can extend radially outward from the circular waveguide. The compact tracking coupler can operate at the second frequency band, generating tracking signals in a similar manner as described above for the compact tracking coupler 100 of FIG. 1.

Although the ridged waveguides 212 are shown here as using rectangular cross sections (plus the ridge), in some embodiments the ridged waveguides can have the circularly truncated circular sector cross-section shape shown in FIG. 1 or other shapes described herein. For example, in some embodiments, the compact tracking coupler 208 can be like the compact tracking coupler 100 shown in FIG. 1.

Various advantages can be obtained by using the compact tracking coupler 208 within the feed 200. For example, because the compact tracking coupler can have a smaller diameter than a conventional tracking coupler, reduced blockage and efficient RF performance of the coaxial waveguide feed can be obtained. In some embodiments, it is possible to position the feed in the front of a parabolic reflector within an antenna assembly (rather than behind). This can help to reduce the overall volume of the antenna assembly as well as reduce the number of counter weights needed to balance the antenna assembly when mounted to a yoke/pedestal.

Various techniques for constructing a compact tracking coupler can be used. In some embodiments, a method of making a compact tracking coupler can include forming a circular waveguide having an outer perimeter. The circular waveguide can have an associated first phase velocity. For example, the circular waveguide can be formed by depositing an electrically conductive material onto a mandrel using electroforming or electroplating. The mandrel can be a rod having a circular cross section. The mandrel can be a sacrificial material that is later removed (e.g., to provide an air dielectric). For example, the mandrel can be aluminum and the electrically conductive material can be copper. The mandrel can be removed (e.g., by etching) and a dielectric material disposed in its place. Alternatively, the mandrel can be a dielectric material which becomes part of the finished compact tracking coupler.

Making a compact tracking coupler can also include configuring a plurality of ridged waveguides. The ridged waveguides can have an associated second phase velocity. The ridged waveguides can be configured so the second phase velocity is substantially equal to the first phase velocity. For example, the ridged waveguides can include a ridge, a dielectric material, or both to achieve a desired phase velocity.

The ridged waveguides can be fabricated on a second mandrel using similar or different techniques as to fabricating the circular waveguide. The second mandrel can be a rod having the desired cross section for the ridged waveguides. Similar to the circular waveguide, the second mandrel can be a dielectric material or a sacrificial material that is removed (and, if desired, replaced with dielectric material).

The ridged waveguides can have two long sides and two short sides (although the long sides need not be equal in length to each other, nor need the short sides be equal in length to each other). As described above, the ridged waveguides can have various cross sections, including for example, circularly truncated circular sector, truncated circular sector, trapezoid, rectangle, dumbbell, bowtie, or the like. The cross section can be modified by one or more inwardly projecting ridges along one of the long sides.

The ridged waveguides can be coupled to the circular waveguide so that a short dimension of the ridged waveguides extends radially with respect to the circular waveguide and a long dimension of the ridged waveguides extends circumferentially with respect to the circular waveguide.

In some embodiments, a compact tracking coupler can be formed as illustrated in FIGS. 3A-3E. A first rod 302 having a circular cross section can be used as form for construction of the circular waveguide. For example, the first rod can be a dielectric material. As another example, the first rod can be a sacrificial material that can be later removed to provide an air dielectric for the circular waveguide. A first electrically conductive material 304 can be formed on the sides of the first rod to create the circular waveguide. For example, the first electrically conductive material can be electroformed on the exterior of the first rod. The first electrically conductive material can be any suitable conductor, including for example, copper, gold, silver, and the like.

A plurality of holes 306 can be created in the first electrically conductive material to serve as the coupling holes. The holes can be created, for example, by etching (e.g., by placing a stencil and etching exposed portions of the first electrically conductive material). As another example, the holes can be created mechanically, for example, by drilling.

A number (e.g., eight) of second rods 308 can be provided that have the desired cross section of the ridged waveguides. For example, the second rods can have a substantially trapezoidal cross section or other shapes as described above. The second rods can be arranged around the exterior of the first electrically material. Second electrically-conductive material 310 can be deposited on the sides of the second rods to form a plurality of ridged waveguides. For example, the second electrically-conductive material can be formed by electroforming, and can be the same or different material from the first electrically-conductive material. If desired, the second rods can be dielectric material.

If desired, the first rod, second rods, or both, can be removed. For example, the rods can be removed to provide for an air dielectric. As another example, the rods can be removed and replaced with a desired dielectric material. The rods can be removed mechanically or chemically (e.g., by dissolving or etching). Absorbers can be placed in one end of the ridged waveguides, if desired. Additional elements can be fabricated or attached to the compact tracking coupler as desired.

In some embodiments, a compact tracking coupler can be formed by forming a complex mandrel shape which corresponds to the interior volume of the circular waveguide, coupling holes, and interior volume of the ridged waveguides. For example, the complex mandrel may be formed by machining, assembly from basic shapes, or any other suitable techniques. Conductive material can be deposited on the complex mandrel to form the outer perimeter of the circular waveguide and the outer perimeter of the ridged waveguides. The conductive material can be deposited using electroforming, electroplating, vapor deposition, or any other suitable technique.

In some embodiments, a compact tracking coupler can be formed using machining. For example, a block of material can be provided and material removed to define the interior of the circular waveguide and the interiors of the ridged waveguides.

Figure 4A:
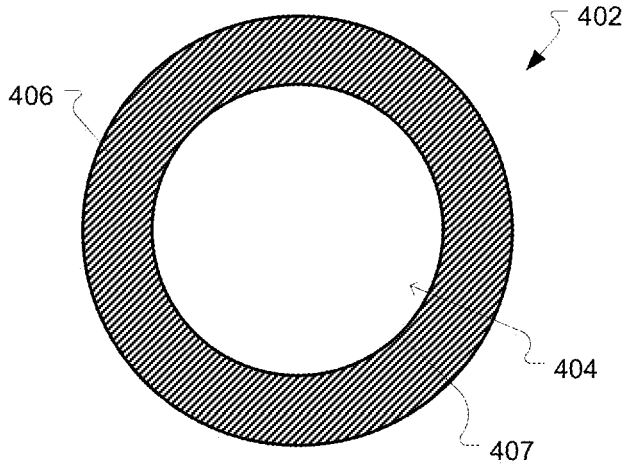
FIGS. 4A-4B illustrate various operations in another method of making a compact tracking coupler in accordance with some embodiments of the present invention.
Figure 4B:
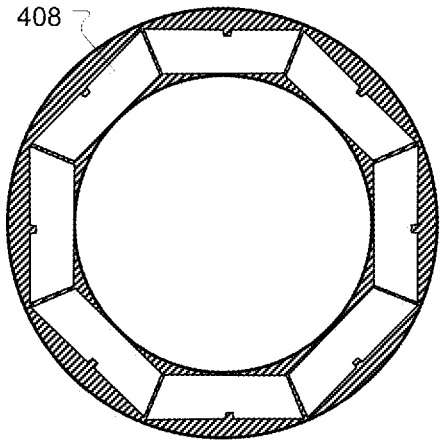

In some embodiments, a compact tracking coupling can be formed as illustrated in FIGS. 4A-4B. As shown in FIG. 4A, a circular waveguide blank 402 can be provided that features an open center portion 404 (defining the inner cross section of the circular waveguide) and additional material 406 extending outward from the outer perimeter 407 of the circular waveguide. Material can be removed, as shown in FIG. 4B, to define the inner cross section 408 of the ridged waveguides. Material can be removed using plunge/sinker electrical discharge machining (EDM), wire EDM, mechanical machining (e.g., drilling, routing, etc.) or any other suitable technique.

While several illustrative applications have been described, many other applications of the presently disclosed techniques may prove useful. Accordingly, the above-referenced arrangements are illustrative of some applications for the principles of the present invention. It will be apparent to those of ordinary skill in the art that numerous modifications can be made without departing from the principles and concepts of the invention as set forth in the claims.

What is claimed is:

1. A compact tracking coupler device for use in a multi-band antenna feed, the compact tracking coupler comprising:

a circular waveguide having an outer perimeter;

a plurality of ridged waveguides each having a pair of short sides and pair of long sides, the ridged waveguides disposed circumferentially around the circular waveguide and positioned with one of the long sides adjacent to the outer perimeter of the circular waveguide and the short sides extending radially outward from the circular waveguide; and a plurality of openings disposed between each of the ridged waveguides and the circular waveguide.

2. The device of claim 1, further comprising:

a first dielectric material disposed within the circular waveguide; and a second dielectric material disposed within each of the ridged waveguides.

3. The device of claim 1, wherein the plurality of ridged waveguides comprises eight ridged waveguides equidistantly spaced about the circular waveguide.

4. The device of claim 1, wherein each of the plurality of ridged waveguides has a trapezoidal cross section.

5. The device of claim 1, wherein each of the plurality of ridged waveguides has a circularly truncated circular sector cross section.

6. The device of claim 1, further comprising an outer enclosure, wherein the circular waveguide and the plurality of ridged waveguides compose a center conductor of a coaxial waveguide feed and the outer enclosure composes an outer conductor of the coaxial waveguide feed.

7. The device of claim 6, wherein the circular waveguide is dimensioned to support operation at K-band and the coaxial waveguide feed is dimensioned to support operation at X-band.

8. The device of claim 1, wherein the plurality of ridged waveguides couple to higher-order TE21 modes propagating within the circular waveguide.

9. A multi-band antenna feed device comprising:

a first frequency band coaxial waveguide feed comprising an outer conductor and an inner conductor, the inner conductor coaxially disposed within the outer conductor, and the inner conductor separated from the outer conductor by a dielectric space, wherein the inner conductor is a compact tracking coupler comprising:

a second frequency band circular waveguide;

a plurality of second frequency band ridged waveguides coupled to an outer perimeter of the circular waveguide, each of the ridged waveguides having a long side coupled to the circular waveguide and each of the ridged waveguides having a short side extending radially outward from the circular waveguide.

10. The device of claim 9, further comprising dielectric material disposed within the circular waveguide and within each of the plurality of ridged waveguides.

11. The device of claim 9, wherein the ridged waveguides each comprise a trapezoidal cross section modified by a ridge.

12. The device of claim 9, wherein the ridged waveguides each comprise a circularly truncated circular sector cross section modified by a ridge.

13. A method of making a compact tracking coupler for use in a multi-band antenna feed, the method comprising:

forming a circular waveguide having an outer perimeter, wherein the circular waveguide has a first phase velocity;

configuring a plurality of ridged waveguides to have a second phase velocity substantially equal to the first phase velocity; and coupling the plurality of ridged waveguides around the circular waveguide so that a short dimension of the ridged waveguides extends radially with respect to the circular waveguide and a long dimension of the ridged waveguides extends circumferentially with respect to the circular waveguide.

14. The method of claim 13, wherein the configuring a plurality of ridged waveguides comprises dielectrically loading the plurality of ridged waveguides.

15. The method of claim 13, wherein the configuring a plurality of ridged waveguides comprises disposing at least one inwardly projecting ridge within a long side of each of the plurality of ridged waveguides, wherein the long side corresponds to the long dimension of the ridged waveguides.

16. The method of claim 13, wherein forming a circular waveguide comprises:

providing a first rod having a circular cross section;

forming a first electrically-conductive material on the sides of the first rod to create the circular waveguide.

17. The method of claim 16, wherein coupling the plurality of ridged waveguides comprises:

creating a plurality of holes in the first electrically-conductive material;

attaching a plurality of second rods to the circular waveguide; and forming a second electrically-conductive material on the sides of the second rods to form the plurality of ridged waveguides coupled to the circular waveguide.

18. The method of claim 17, wherein the first rod and the second rod are each dielectric material.

19. The method of claim 17, further comprising:

removing one of the first rod and the second rod to leave open space; and disposing a dielectric material into the open space.

20. The method of claim 13, wherein:

the forming a circular waveguide comprises providing material extending outwardly from the outer perimeter; and the configuring a plurality of ridged waveguides comprises removing portions of the material to define the inner cross section of the plurality of ridged waveguides.

* * * * *